US010822137B2

(12) United States Patent
Smith

(10) Patent No.: US 10,822,137 B2
(45) Date of Patent: Nov. 3, 2020

(54) CONTAINER FOR HOLDING TUBS AND A BLANK FOR MAKING THE SAME

(71) Applicant: WestRock Shared Services, LLC, Atlanta, GA (US)

(72) Inventor: Kenneth C. Smith, Marietta, GA (US)

(73) Assignee: WestRock Shared Services, LLC, Atlanta, GA (US)

( * ) Notice: Subject to any disclaimer, the term of this patent is extended or adjusted under 35 U.S.C. 154(b) by 0 days.

(21) Appl. No.: 16/244,189

(22) Filed: Jan. 10, 2019

(65) Prior Publication Data

US 2019/0217987 A1 Jul. 18, 2019

Related U.S. Application Data

(60) Provisional application No. 62/617,854, filed on Jan. 16, 2018.

(51) Int. Cl.

| | |
|---|---|
| ***B65D 5/50*** | (2006.01) |
| ***B65D 5/20*** | (2006.01) |
| ***B65D 5/489*** | (2006.01) |
| ***B31B 50/26*** | (2017.01) |
| ***B65D 5/42*** | (2006.01) |
| ***B65D 71/72*** | (2006.01) |

(52) U.S. Cl.

CPC ..... *B65D 5/5021* (2013.01); *B31B 50/26* (2017.08); *B65D 5/20* (2013.01); *B65D 5/4266* (2013.01); *B65D 5/4295* (2013.01); *B65D 5/4802* (2013.01); *B65D 71/72* (2013.01)

(58) Field of Classification Search

CPC .. B65D 5/4802; B65D 5/2095; B65D 5/5021; B65D 5/5007

USPC ..... 229/120.14–120.16, 904, 165

See application file for complete search history.

(56) References Cited

U.S. PATENT DOCUMENTS

| | | | | |
|---|---|---|---|---|
| 3,174,674 | A * | 3/1965 | Wagner | B65D 5/5021 206/564 |
| D515,942 | S * | 2/2006 | Hamblin | D24/230 |
| 8,887,984 | B2 | 11/2014 | Bahr | |
| 9,409,669 | B2 | 8/2016 | Bahr | |
| 9,828,131 | B2 | 11/2017 | James et al. | |

(Continued)

FOREIGN PATENT DOCUMENTS

| | | | | |
|---|---|---|---|---|
| DE | 2201641 | A1 * | 7/1973 | B65D 5/2047 |

*Primary Examiner* — Nathan J Newhouse
*Assistant Examiner* — Phillip D Schmidt
(74) *Attorney, Agent, or Firm* — WestRock Intellectual Property Group

(57) ABSTRACT

A blank for forming a container includes a bottom panel, end panels, and side panels. A first divider panel assembly is defined within the bottom panel and an end panel and includes an upper panel defined within the end panel and an inner panel defined within the bottom panel. The upper panel is configured to be at an angle to the end panel, and the inner panel is configured to be at an angle to the bottom panel in an erected configuration. Second and third divider panel assemblies are defined within the bottom panel and a side panel. The second and third divider panel assemblies include an upper panel defined within the side panel and an inner panel defined within the bottom panel. The panels of the second and third divider panel assemblies are configured similarly to the panels of the first divider panel assembly in the erected configuration.

2 Claims, 11 Drawing Sheets

(56) References Cited

U.S. PATENT DOCUMENTS

2015/0048150 A1* 2/2015 Bahr ..... B65D 71/0007
229/120.29

* cited by examiner

CONTAINER FOR HOLDING TUBS AND A BLANK FOR MAKING THE SAME

REFERENCE TO RELATED APPLICATION

This application claims the benefit of priority under 35 U.S.C. § 119(e) of U.S. provisional application Ser. No. 62/617,854 filed on Jan. 16, 2018, which is hereby incorporated by reference in its entirety.

BACKGROUND

The embodiments described herein relate generally to a container formed from a blank of sheet material and, more particularly, to a container for supporting a plurality of tubs included within the container.

At least some known containers are configured to hold a plurality of tubs therein. Most of these known containers are formed from a relatively large blank having a plurality of panels that fold and/or wrap to define tub holders. More specifically, the plurality of panels forms a rectangular container having cutouts into which the tubs are inserted. Because these containers are formed from a relatively large blank of sheet material they can be expensive to make. Moreover, because of the plurality of panels, they can be complicated to form.

Other known containers include single-thickness side and end walls having a cup holder that extends outwardly from each end wall. The end walls of such a container include side flaps that couple to an adjacent side wall. The end walls and side flaps are taller than the side walls. As such, when a cup is positioned in the container, the cup is secured by the combination of the cup holder, the end wall, and the side flap. Notably, the retractable cup holders only extend from the end walls because the end wall and side flap cooperate with the cup holder to secure the cup in the container. Further, the central portion of the container is configured to allow for other food items to be positioned therein. As such, these known containers are limited in the number of tubs or cups it is able to support therein.

Other known containers include side and end walls having spacing panels that support tubs and keep the tubs from hitting the side and end walls of the container. The spacing panels rest toward the bottom of the tubs, and there are no spacing panels in the middle of the container. As such, the tubs can nest into each other causing leaking, breaking, and/or spilling when the tubs are transported.

BRIEF DESCRIPTION

In one aspect, a blank for forming a container is provided. The blank includes a bottom panel, a pair of opposing end panels connected to the bottom panel, and a pair of opposing side panels connected to the bottom panel. A first divider panel assembly is defined within the bottom panel and a first end panel of the pair of end panels. The first divider panel assembly includes a first upper panel and a first inner panel connected at a first fold line. The first upper panel is defined within the first end panel, and the first inner panel is defined within the bottom panel. In an erect configuration, the first upper panel is configured to be at a first angle to the first end panel, and the first inner panel is configured to be at a second angle to the bottom panel. A second divider panel assembly is defined within the bottom panel and a first side panel of the pair of side panels. The second divider panel assembly includes a second upper panel and a second inner panel connected at a second fold line, and the second fold line is offset from the first fold line. The second upper panel is defined within the first side panel, and the second inner panel is defined within the bottom panel. In an erect configuration, the second upper panel is configured to be at a third angle to the first side panel, and the second inner panel is configured to be at a fourth angle to the bottom panel. The second divider panel assembly is offset from the pair of opposing side panels. A third divider panel assembly is defined within the bottom panel and the first side panel of the pair of side panels. The third divider panel assembly includes a third upper panel and a third inner panel connected at a third fold line, and the third fold line is offset from the first and second fold lines. The third upper panel is defined within the first side panel, and the third inner panel is defined within the bottom panel. In an erect configuration, the third upper panel is configured to be at a fifth angle to the first side panel, and the third inner panel is configured to be at a sixth angle to the bottom panel. The third divider panel assembly is offset from the pair of opposing side panels. A first arcuate cutout is defined within the first side panel of the pair of side panels and the bottom panel around the second divider panel assembly. The first arcuate cutout begins at the second upper panel and ends at the second fold line of the second divider panel assembly. A second arcuate cutout is defined within the first side panel of the pair of side panels and the bottom panel around the third divider panel assembly. The second arcuate cutout begins at the third upper panel and ends at the third inner panel of the third divider panel assembly.

In another aspect, a container formed from a blank of sheet material is provided. The container includes a bottom wall, a pair of opposing end walls connected to the bottom wall, and a pair of opposing side walls connected to the bottom walls. A first divider structure extends from the bottom wall and a first end wall of the pair of end walls. The first divider structure includes a first upper panel and a first inner panel connected at a first fold line. The first upper panel is at a first angle to the first end wall, and the first inner panel is at a second angle to the bottom wall. A second divider structure extends from the bottom wall and a first side wall of the pair of side walls. The second divider structure includes a second upper panel and a second inner panel connected at a second fold line. The second upper panel is at a third angle to the first side wall, and the second inner panel is at a fourth angle to the bottom wall. The second fold line is offset from the first foldline.

In yet another aspect, a method for forming a container from a blank of sheet material is provided. The blank of sheet material includes a bottom panel, a pair of opposing end panels connected to the bottom panel, a pair of opposing side panels connected to the bottom panel, a first divider panel assembly defined within the bottom panel and a first side panel of the pair of side panels, and a second divider panel assembly defined within the bottom panel and a first end panel of the pair of end panels. The first divider panel assembly includes a first upper panel defined within the first side panel and a first inner panel defined within the bottom panel. The second divider panel assembly includes a second upper panel defined within the first end panel and a second inner panel defined within the bottom panel. The method includes rotating the pair of side panels toward the bottom panel to form a pair of opposing side walls, rotating the first upper panel with respect to the first side panel and the first inner panel with respect to the bottom panel to form a first divider structure, rotating the pair of end panels toward the bottom panel to form a pair of opposing end walls, and rotating the second upper panel with respect to the first end panel and the second inner panel with respect to the bottom panel to form a second divider structure.

BRIEF DESCRIPTION OF THE DRAWINGS

FIG. 1 is a top view of an exemplary blank of sheet material for forming a 3×4 container.

FIG. 2 is a perspective view of an exemplary 3×4 container formed from the blank shown in FIG. 1.

FIG. 3 is a top view of an exemplary blank of sheet material for forming a 2×3 container.

FIG. 4 is a top view of an exemplary blank of sheet material for forming a 2×6 container.

FIG. 5 is a top view photo of the exemplary blank shown in FIG. 1.

FIG. 6 is a perspective view photo of the exemplary 3×4 container shown in FIG. 2.

FIG. 7 is a top view photo of the exemplary 3×4 container shown in FIG. 2.

FIG. 8 is a side perspective view photo of the exemplary 3×4 container shown in FIG. 2.

FIG. 9 is a top view photo of the exemplary 3×4 container shown in FIG. 2 having tubs therein.

FIG. 10 is a top view of an exemplary blank of sheet material for forming a 2×3 container with a lid.

FIG. 11 is a perspective view of an exemplary 3×4 container with a lid formed from the blank shown in FIG. 10.

DETAILED DESCRIPTION

The embodiments described herein provide a container configured to support and/or contain a plurality of tubs and/or products. For example, the containers described herein can be used to contain a plurality of cylindrical tubs, such as dairy tubs, during transport through an assembly line and/or to a store and/or during storage of the tubs.

The following detailed description illustrates the disclosure by way of example and not by way of limitation. The description clearly enables one skilled in the art to make and use the disclosure, and describes several embodiments, adaptations, variations, alternatives, and use of the disclosure, including what is presently believed to be the best mode of carrying out the disclosure.

A container formed from a single sheet of material and a method for constructing the container is described herein. The container may be constructed from a blank of sheet material using a machine. In one embodiment, the container is fabricated from a cardboard material. The container, however, may be fabricated using any suitable material, and therefore is not limited to a specific type of material. In alternative embodiments, the container is fabricated using cardboard, plastic, fiberboard, paperboard, foamboard, corrugated paper, and/or any suitable material known to those skilled in the art and guided by the teachings herein provided.

In an example embodiment, the container includes at least one marking thereon including, without limitation, indicia that communicates the product stored in the container, a manufacturer of the product and/or a seller of the product. For example, the marking may include printed text that indicates a product's name and briefly describes the product, logos, and/or trademarks that indicate a manufacturer and/or seller of the product, and/or designs and/or ornamentation that attract attention. "Printing," "printed," and/or any other form of "print" as used herein may include, but is not limited to, ink jet printing, laser printing, screen printing, giclée, pen and ink, painting, offset lithography, flexography, relief print, rotogravure, dye transfer, and/or any suitable printing technique known to those skilled in the art and guided by the teachings herein provided. In another embodiment, the container is void of markings, such as, without limitation, indicia that communicates the product, a manufacturer of the product, and/or a seller of the product.

Figure 1:
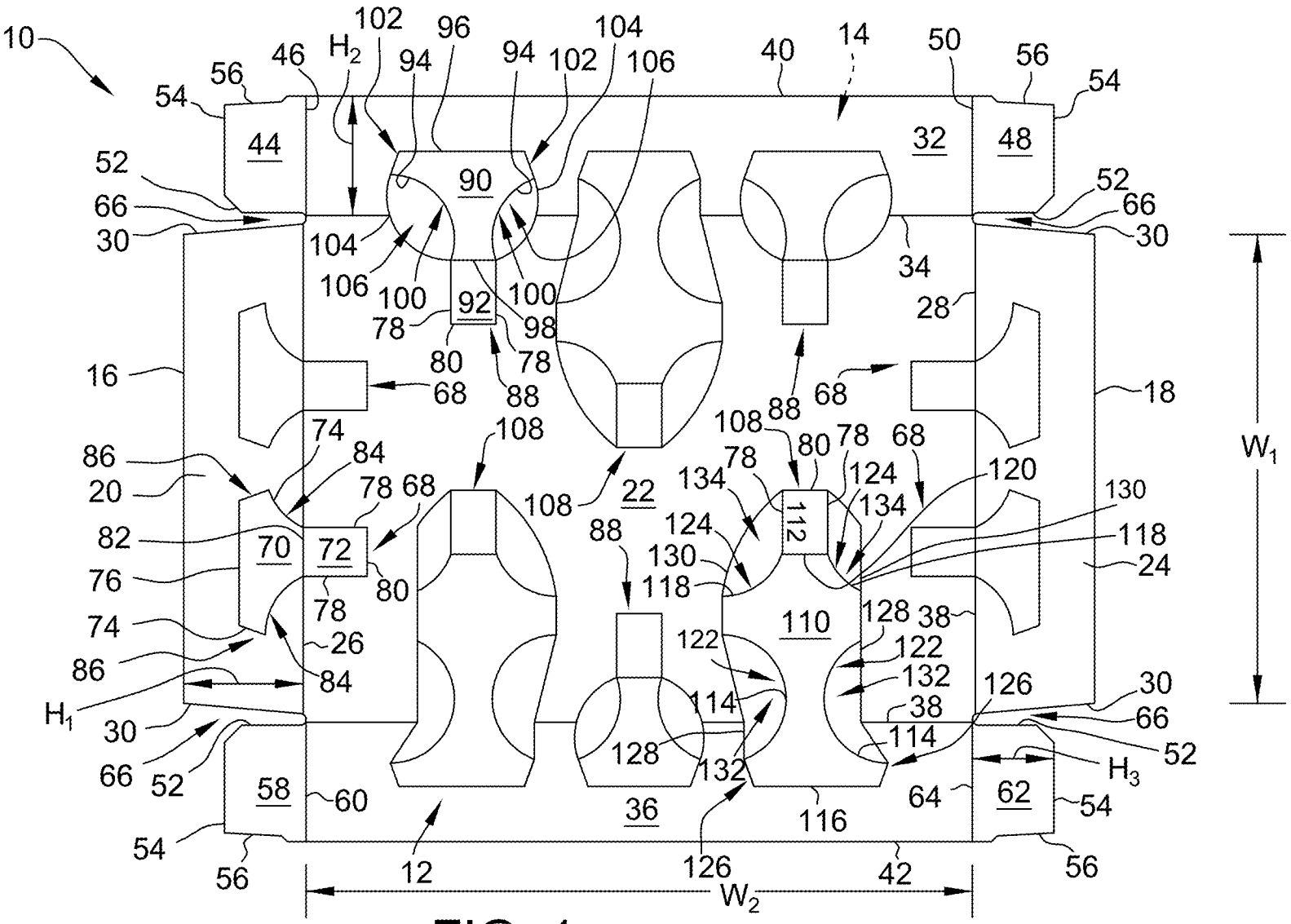
FIGS. 1-11 show exemplary embodiments of the blanks, containers, and methods described herein.
Figure 2:
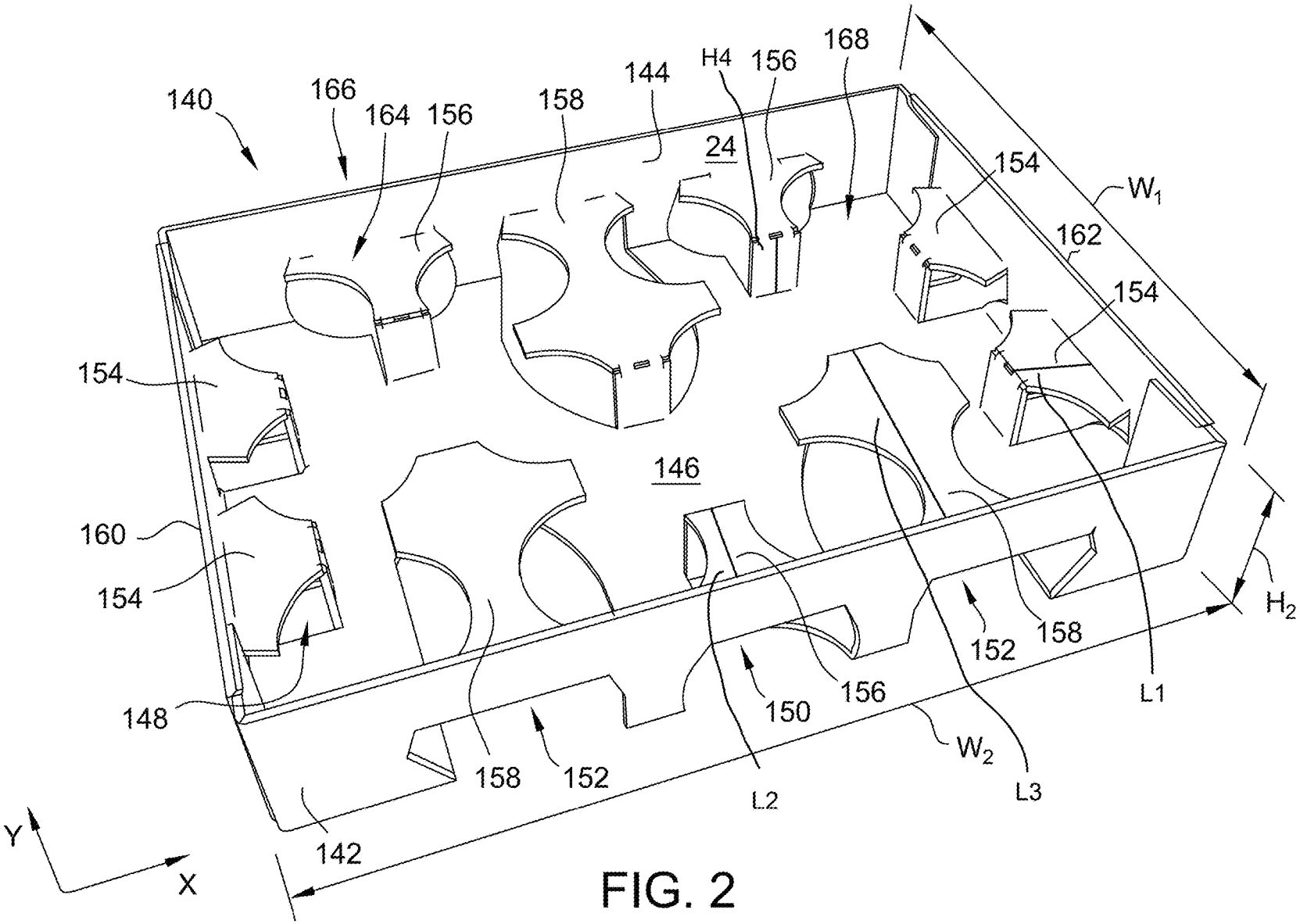

Referring now to the drawings, FIG. 1 is a top view of an exemplary blank 10 of sheet material for forming a container, such as a container 140 (shown in FIG. 2). Blank 10 has a first or interior surface 12 and an opposing second or exterior surface 14. Further, blank 10 defines a first edge 16 and an opposing second edge 18. In one embodiment, blank 10 includes, in series from first edge 16 to second edge 18, a first end panel 20, a bottom panel 22, and a second end panel 24 coupled together along preformed, generally parallel, fold lines 26 and 28, respectively. More specifically, first end panel 20 extends from first edge 16 to fold line 26, bottom panel 22 extends from first end panel 20 along fold line 26 to second end panel 24 along fold line 28, and second end panel 24 extends from bottom panel 22 along fold line 28 to second edge 18. Fold lines 26 and/or 28, as well as other fold lines and/or hinge lines described herein, may include any suitable line of weakening and/or line of separation known to those skilled in the art and guided by the teachings herein provided. In the exemplary embodiment, each end panel 20 and 24 includes free side edges 30. When container 140 is formed from blank 10, fold line 26 defines a bottom edge of first end panel 20 and a first end edge of bottom panel 22, fold line 28 defines a second end edge of bottom panel 22 and a bottom edge of second end panel 24, first edge 16 defines a top edge of first end panel 20, and second edge 18 defines a top edge of second end panel 24.

A first side panel 32 extends from a first side edge of bottom panel 22 at a fold line 34, and a second side panel 36 extends from a second side edge of bottom panel 22 at a fold line 38. Fold lines 34 and 38 are substantially parallel. First side panel 32 has a free edge 40 that defines a top edge of first side panel 32 when container 140 is formed, and second side panel 36 has a free edge 42 that defines a top edge of second side panel 36 when container 140 is formed. A first end flap 44 extends from an end edge of first side panel 32 at a fold line 46, and a second end flap 48 extends from an opposing end edge of first side panel 32 at a fold line 50. Each end flap 44 and 48 includes free edges 52, 54, and 56. Similarly, a third end flap 58 extends from an end edge of second side panel 36 at a fold line 60, and a fourth end flap 62 extends from an opposing end edge of second side panel 36 at a fold line 64. Each end flap 58 and 62 includes free edges 52, 54, and 56. In the exemplary embodiment, each end flap 44, 48, 58, and 62 is separated from an adjacent end panel 20 or 24 by a gap 66. However, it should be understood that any of end flaps 44, 48, 58, and/or 62 can be separated from an adjacent end panel 20 or 24 by a cut line without gap 66.

Each end panel 20 and 24 has a height $H_1$, and each side panel 32 and 36 has a height $H_2$. In the exemplary embodiment, height $H_1$ is substantially equal to height $H_2$. Alternatively, height $H_1$ is other than substantially equal to height $H_2$, for example less than or greater than height Hz. In the exemplary embodiment, end flaps 44, 48, 58, and 62 each have a height H3 that is approximately equal to, or slightly smaller than height $H_2$. Further, end panels 20 and 24 each have a width $W_1$, and side panels 32 and 36 each have a width $W_2$ that is larger than width $W_1$. Alternatively, width $W_2$ is equal to or less than width $W_1$ depending on what type and/or how many tubs container 140 supports therein. In the exemplary embodiment, blank 10 is configured to hold 3 tubs along width $W_1$ and 4 tubs along width $W_2$ when container 140 is formed.

Blank 10 further includes a plurality of first divider panel assemblies 68. In the exemplary embodiment, blank 10 includes a first divider panel assembly 68 defined within at least one end panel 20 and/or 24. Each first divider panel assembly 68 is configured similarly and is referred to generically as first divider panel assembly 68 for the sake of simplicity. In the exemplary embodiment, each end panel 20 and 24 includes two first divider panel assemblies 68. In the exemplary embodiment, first divider panel assemblies 68 have any suitable size and/or configuration based on the tubs supported by container 140. Further, first divider panel assemblies 68 are configured to cooperate with an adjacent first divider panel assembly 68 to secure a substantial portion of a circumference of the tubs that is closest to end panels 20 and/or 24 within container 140. In the exemplary embodiment, the substantial portion of the circumference of the tubs that is closest to end panel 20 and/or 24 within container 140 is about 30% of the circumference of the tub. For example, each of the tubs closest to end panels 20 and 24 is in contact with one or two first divider panel assemblies 68.

In the exemplary embodiment, each first divider panel assembly 68 includes an upper panel 70 defined within end panel 20 and/or 24 and an inner panel 72 defined within bottom panel 22. More specifically, upper panel 70 is defined within an end panel 20 and 24 by side cut lines 74 and a fold line 76. Inner panel 72 is defined within bottom panel 22 by side cut lines 78 and a fold line 80. Side cut lines 78 are continuous with side cut lines 74 across a respective fold line 26 and/or 28. Upper panel 70 and inner panel 72 are connected to each other at a fold line 82 that is substantially collinear with a respective fold line 26 or 28. Alternatively, fold line 82 is offset from a respective fold line 26 or 28.

Upper side cut lines 74 include at least an arcuate edge 84 to correspond to a shape of the tubs supported by container 140. In the exemplary embodiment, upper side cut lines 74 include arcuate edge 84 and a substantially straight portion 86. More specifically, arcuate edge 84 has an edge configured to interface with or engage a tub supported within container 140. As such, arcuate edge 84 of upper side cut lines 74 defines an engagement edge of first divider panel assembly 68.

Blank 10 further includes a plurality of second divider panel assemblies 88. In the exemplary embodiment, blank 10 includes a second divider panel assembly 88 defined within at least one side panel 32 and/or 36. Each second divider panel assembly 88 is configured similarly and is referred to generically as second divider panel assembly 88 for the sake of simplicity. In the exemplary embodiment, side panel 32 includes two second divider assemblies 88 and side panel 36 includes one second divider panel assemblies 88. In the exemplary embodiment, second divider panel assemblies 88 have any suitable size and/or configuration based on the tubs supported by container 140. Further, second divider panel assemblies 88 are configured to cooperate with an adjacent first divider panel assembly 68 and an adjacent third divider panel assembly 108, described below, to secure a substantial portion of a circumference of the tubs within container 140. In the exemplary embodiment, the substantial portion of the circumference of the tubs within container 140 that is secured by the divider panel assemblies 68, 88, and 108 is about 30% of the circumference of the tubs.

In the exemplary embodiment, each second divider panel assembly 88 includes an upper panel 90 defined within side panel 32 and/or 36 and an inner panel 92 defined within bottom panel 22. More specifically, upper panel 90 is defined within side panel 32 and 36 by side cut lines 94 and a fold line 96. Inner panel 92 is defined within bottom panel 22 by side cut lines 78 and a fold line 80 which are substantially the same as side cut lines 78 and fold line 80 of first divider panel assembly 68. Side cut lines 78 are continuous with side cut lines 94 across a respective fold line 34 and/or 38. Upper panel 90 and inner panel 92 are connected to each other at a fold line 98 that is offset from fold lines 34 and/or 38.

Upper side cut lines 94 include at least a arcuate edge 100 to correspond to a shape of the tubs supported by container 140. In the exemplary embodiment, upper side cut lines 94 include arcuate edge 100 and a substantially straight portion 102. More specifically, arcuate edge 100 has an edge configured to interface with or engage a tub supported within container 140. As such, arcuate edge 100 of upper side cut lines 94 defines an engagement edge of second divider panel assembly 88.

Cutout lines 104 extend through bottom panel 22 to side panel 32 and 36 across respective fold line 34 and 38, around second divider panel assemblies 88. Cutout lines 104 are arcuate lines that extend from fold line 98 to fold line 96 of second divider panel assemblies 88. Cutout lines 104 make cutouts 106. Specifically, cutouts 106 are formed from stripped out material of blank 10.

Blank 10 further includes a plurality of third divider panel assemblies 108. In the exemplary embodiment, blank 10 includes a third divider panel assembly 108 defined within at least one side panel 32 and/or 36. Each third divider panel assembly 108 is configured similarly and is referred to generically as third divider panel assembly 108 for the sake of simplicity. In the exemplary embodiment, side panel 32 includes one third divider assembly 108 and side panel 36 includes two third divider panel assemblies 108. In the exemplary embodiment, third divider panel assemblies 108 alternate with second divider panel assemblies 88 along side panels 32 and 36. In the exemplary embodiment, third divider panel assemblies 108 have any suitable size and/or configuration based on the tubs supported by container 140. Further, third divider panel assemblies 108 are configured to cooperate with adjacent first divider panel assemblies 68 and/or adjacent second divider panel assemblies 88, described above, to secure a substantial portion of a circumference of the tubs within container 140. In the exemplary embodiment, the substantial portion of the circumference of the tubs that is secured by divider panel assemblies 68, 88, and 108 is about 30% of the total circumference of the tubs. Third divider panel assemblies 108 ensure that container 140 can secure three containers along width $W_1$. For example, a tub placed in the middle of bottom panel 22 of container 140 is in contact with two third divider panel assemblies 108. Further, for example, a tub placed between end panel 24 and side panel 36 is in contact with one third divider panel assembly 108 and one first divider panel assembly 68.

In the exemplary embodiment, each third divider panel assembly 108 includes an upper panel 110 defined within a side panel 32 and/or 36 and an inner panel 112 defined within bottom panel 22. More specifically, upper panel 110 is defined within side panel 32 and 36 by upper side cut lines 114, fold line 116, and upper side cut lines 118. Inner panel 112 is defined within bottom panel 22 by side cut lines 78 and a fold line 80 which are substantially the same as side cut lines 78 and fold line 80 of first divider panel assembly 68 and second divider panel assembly 88. Upper side cut lines 114 are arcuate and cross a respective fold line 34 and/or 38. Upper side cut lines 118 are arcuate and continuous with side cut lines 78 of bottom panel 22. Upper panel 110 and inner panel 112 are connected to each other at a fold line 120 that is offset from fold lines 34 and/or 38.

Upper side cut lines 114 include a arcuate edge 122 and upper side cut lines 118 include an arcuate edge 124 to correspond to a shape of the tubs supported by container 140. In the exemplary embodiment, upper side cut lines 114 include arcuate edge 122 and a substantially straight portion 126. More specifically, arcuate edges 122 and 124 have an edge configured to interface with or engage a tub supported within container 140. As such, arcuate edges 122 and 124 of upper side cut lines 114 and 118 define an engagement edge of third divider panel assembly 108. Engagement edges of adjacent first divider panel assemblies 68, second divider panel assemblies 88, and third divider panel assemblies 108 are configured to cooperate with each other to secure a tub within container 140 in the erected configuration. The engagement edges defined by arcuate edges 84 of first divider panel assemblies 68, arcuate edge 100 of second divider panel assemblies 88, and arcuate edges 122 and 124 of third divider panel assemblies 108 configured to space the tubs from the end panels 20 and 24 and side panels 32 and 36 and from other tubs, and to engage a substantial portion of a circumference of the tubs in container 140 to ensure that the tubs do not move in transit. In other embodiments, the engagement edges may engage less than half of a circumference, three-quarters of a circumference, or any other suitable portion of a circumference of the tubs in container 140 to ensure that the tubs are secured and will not nest into each other in transit.

Cutout lines 128 extend through bottom panel 22 to side panel 32 and 36 across respective fold line 34 and 38, around third divider assemblies 108. Cutout lines 130 extend through bottom panel 22 around third divider panel assemblies 108. Cutout lines 128 are generally arcuate lines that extend from substantially straight portion 126 to bottom panel 22. Cutout lines 130 extend from a portion of bottom panel 22 to fold line 80 of third divider assemblies 108. Cutout lines 128 make cutouts 132, and cutout lines 130 make cutouts 134. Specifically, cutouts 132 and 134 are formed from stripped out material of blank 10.

When blank 10 is in a flat, unformed state, first divider panel assemblies 68, second divider panel assemblies 88, and third divider panel assemblies 108 are in a flat configuration. More specifically, upper panels 70, 90, and 110 are coplanar with a respective panel 20, 24, 32, or 36, and inner panels 72, 92, and 112 are coplanar with bottom panel 22 in the flat configuration.

FIG. 2 is a perspective view of blank 10 (shown in FIG. 1) constructed into container 140. The herein-described method for forming container 140 from blank 10 can be performed manually and/or automatically.

Referring to FIGS. 1 and 2, to construct container 140 from blank 10, side panels 32 and 36 are rotated about fold lines 34 and 38 toward bottom panel 22 to be substantially perpendicular to bottom panel 22 to form a first side wall 142 and a second side wall 144. Bottom panel 22 forms a bottom wall 146. As side panels 32 and 36 are rotated, first divider panel assemblies 68 begin to buckle inwardly at fold lines 76, 80, and 82, second divider panel assemblies 68 begin to buckle at fold lines 80, 96, and 98, and third divider panel assemblies 108 begin to buckle at fold lines 80, 116, and 120. More specifically, interior surface 12 of upper panels 70, 90, and 110 rotate about fold lines 76, 96, and 116, respectively, toward interior surface 12 of a respective end panel 20 or 24, or a respective side panel 32 or 36, and interior surface 12 of inner panels 72, 92, and 112 rotate about fold lines 80 toward interior surface 12 of bottom panel 22. Upper panels 70, 90, and 110 and inner panels 72, 92, and 112 rotate with respect to each respective other at fold lines 82, 98, and 120, respectively. As first, second, and third divider panel assemblies 68, 88, and 108, respectively, begin to buckle, openings 148, 150, and 152, respectively are formed at each divider panel assembly 68, 88, and 108 in bottom wall 146 and a respective side wall 142 or 144 or respective end wall 160 or 162. Openings 150 and 152 are made from cutouts 106 and merged cutouts 132 and 134, respectively. Cutouts 106, 132, and 134 facilitate the forming of container 140 without pinch points, or resistance between upper side cut lines 94 and 114 and respective side panels 32 and 36. Cutouts 106, 132, and 134 reduce resistance in the forming of container 140, making container 140 faster and easier to form.

When side panels 32 and 36 are substantially perpendicular to bottom panel 22, upper panels 70, 90, and 110 are at an angle, such as a right angle, to a respective side wall 142 or 144 and inner panels 72, 92, and 112 are at an angle, such as a right angle, to bottom wall 146. In the exemplary embodiment shown in FIG. 2, upper panels 70, 90, and 110 are substantially parallel to bottom wall 146 and inner panels 72, 92, and 112 are substantially parallel to side walls 142 and 144. As such, upper panels 70, 90, and 110 are substantially perpendicular to inner panels 72, 92, and 112, respectively. Alternatively, upper panels 70, 90, and 110 are at any suitable angle to inner panels 72, 92, and 112, respectively. Such a configuration of first, second, and third divider panel assemblies 68, 88, and 108, respectively, are referred to as an erected configuration. In the erected configuration, first, second, and third divider panel assemblies 68, 88, and 108, respectively, form divider structures 154, 156, and 158, respectively, associated with side walls 142 and 144.

End flaps 44, 48, 58, and 62 are rotated about fold lines 46, 50, 60, and 64 respectively to be substantially perpendicular to a respective side panel 32 or 36. In the exemplary embodiment as shown in FIG. 2, end flaps 44, 48, 58, and 62 are rotated as side panels 32 and 36 are rotated; however, it should be understood that end flaps 44, 48, 58, and/or 62 can be additionally or alternatively rotated before and/or after side panels 32 and 36 are rotated. In a particular embodiment, end flaps 44, 48, 58, and 62 are not rotated until end panels 20 and 24 are rotated as described below. In such an embodiment, end flaps 44, 48, 58, and 62 are secured to exterior surface 14 of end panels 20 and 24, rather than secured to interior surface 12 of end panels 20 and 24, as described herein. In the exemplary embodiment, when side panels 32 and 36 are substantially perpendicular to bottom wall 146, end flaps 44, 48, 58, and 62 are also substantially perpendicular to bottom wall 146, as shown in FIG. 2.

End panels 20 and 24 are rotated about fold lines 26 and 28 toward bottom panel 22 to be substantially perpendicular to bottom wall 146. Exterior surface 14 of end flaps 44, 48, 58, and 62 are coupled to interior surface 12 of an adjacent end panels 20 and 24, respectively, to form first end wall 160 and second end wall 162. More specifically, first end wall 160 includes first end panel 20, first end flap 44, and third end flap 58. Similarly, second end wall 162 includes second end panel 24, second end flap 48, and fourth end flap 62. In the exemplary embodiment, end walls 160 and 162 and side walls 142 and 144 have substantially the same height.

As end panels 20 and 24 are rotated, first, second, and third divider panel assemblies 68, 88, and 108, respectively, associated with end panels 20 and 24 begin to buckle inwardly. First divider panel assembly 68 begins to buckle inwardly at fold lines 76, 80, and 82. Second divider panel assembly 88 begins to buckle inwardly at fold lines 80, 96, and 98. Third divider panel assembly 108 begins to buckle inwardly at fold lines 80, 116, and 120. More specifically, interior surface 12 of upper panels 70, 90, and 110 rotate about fold lines 76, 96, and 116, respectively, toward interior surface 12 of a respective end panel 20 or 24, and interior surface 12 of inner panels 72, 92, and 112 rotate about fold lines 80 toward interior surface 12 of bottom panel 22. Upper panels 70, 90, and 110 and inner panels 72, 92, and 112, respectively, rotate with respect to each other at fold lines 82, 98, and 120, respectively. As divider panel assemblies 68, 88, and 108 begin to buckle, openings 148, 150, and 152, respectively, are formed at each divider panel assembly 68, 88, and 108 in bottom wall 146 and a respective end wall 160 or 162. When end panels 20 and 24 are substantially perpendicular to bottom wall 146, upper panels 70, 90, and 110 are at an angle, such as a right angle, to a respective end wall 160 or 162, and inner panels 72, 92, and 112 are at an angle, such as a right angle, to bottom wall 146. In the exemplary embodiment shown in FIG. 2, upper panels 70, 90, and 110 are substantially parallel to bottom wall 146 and inner panels 72, 92, and 112 are substantially parallel to end walls 160 and 162. As such, upper panels 70, 90, and 110 are substantially perpendicular to inner panels 72, 92, and 112, respectively. In the erected configuration, divider panel assemblies 68, 88, and 108 form divider structures 154, 156, and 158, respectively, associated with end walls 160 and 162.

In the exemplary embodiment, an upper surface 164 of each divider structure 154, 156, and 158 is below a top edge 166 of walls 142, 144, 160, and 162. Further, each upper panel 70, 90, and 110 is at an angle to a respective wall 142, 144, 160, and 162, and each inner panel 72, 92, and 112 is at an angle to bottom wall 146. In the exemplary embodiment, the angles are substantially right angles; however, the angles can be any suitable angle that is other than 0 or 180 degrees. In the exemplary embodiment, upper panel 70 of first divider structure 154 has length $L_1$, upper panel 90 of second divider structure 156 has length $L_2$, and upper panel 110 of third divider structure 158 has length $L_3$. $L_3$ is the largest of the lengths, $L_2$ is smaller than length $L_3$ and larger than length $L_1$, and length $L_1$ is the smallest of the lengths. Inner panel 92 of second divider structure 156 has height H4. Inner panels 72, 92, and 112 all the same height H4. In the exemplary embodiment, inner panels 72, 92, and 112 have the same height so that the lids of tubs 900 (shown in FIG. 9) do not nest into each other in transit.

Figure 9:
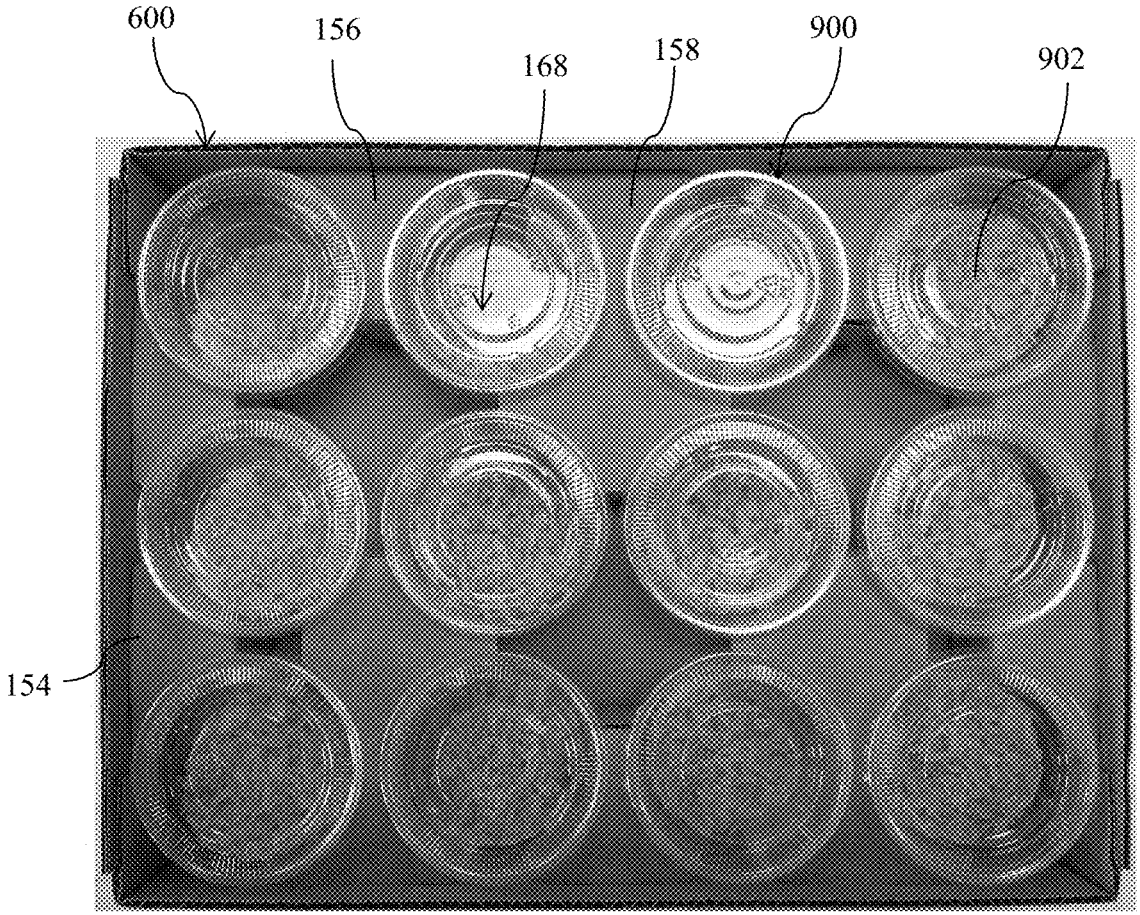

As shown in FIG. 9, tubs 900 are positioned within a cavity 168 of container 140 between at least two divider structures 154, 156, and 158. When tubs 900 are positioned in container 140, the free side edges of upper panels 70, 90, and 110 act as engagement edges and contact sides of tubs 900 to secure tubs 900 within container 140. In the exemplary embodiment, adjacent engagement edges of two adjacent first, second, and third divider structures 154, 156, and 158 cooperate to secure tubs 900 in container 140. In other embodiments, engagement edges of two or three adjacent first, second, and third divider structures 154, 156, and 158 may cooperate to secure tubs 900 in container 140. Further, tubs 900 are spaced from walls 142, 144, 160, and 162 and from other tubs 900 by upper panels 70, 90, and 110. Further, top edge 166 of walls 142, 144, 160, and 162 is above a top 902 of tubs 900. Although the exemplary embodiments are described herein as being configured to support twelve tubs 900, it should be understood that blank 10 and container 140 can be configured to contain any number of tubs 900.

At least one divider structure 154, 156, and 158 can be collapsed to provide container 140 having at least one less cavity 168. More specifically, a force is applied to interior surface 12 around fold lines 82, 98, or 120 to rotate upper panels 70, 90, and 110 about fold lines 76, 96, and 116 respectively and inner panels 72, 92, and 112 about fold lines 80 until upper panel 70, 90, and/or 110 is substantially coplanar with a respective panel 20, 24, 32, or 36 and inner panel 72, 92, and/or 112 is substantially coplanar with bottom panel 22. Such a configuration is referred to as a collapsed configuration, and may be used to store or transport containers 140. In the collapsed configuration, inner panels 72, 92, and 112 form a portion of bottom wall 146, and upper panels 70, 90, and 110 form a portion of an associated wall 142, 144, 160, and 162. Divider structures 154, 156, and 158 can be re-formed to the erected configuration by applying a force to exterior surface 14 around fold lines 82, 98, and 120, respectively to rotate upper panels 70, 90, and 110, respectively, about fold lines 76, 96, and 116, respectively, and inner panels 72, 92, and 112 about fold lines 80 until upper panels 70, 90, and 110 are substantially perpendicular to a respective wall 142, 144, 160, and 162 and inner panel 72, 92, and 112 are substantially perpendicular to bottom wall 146.

Figure 3:
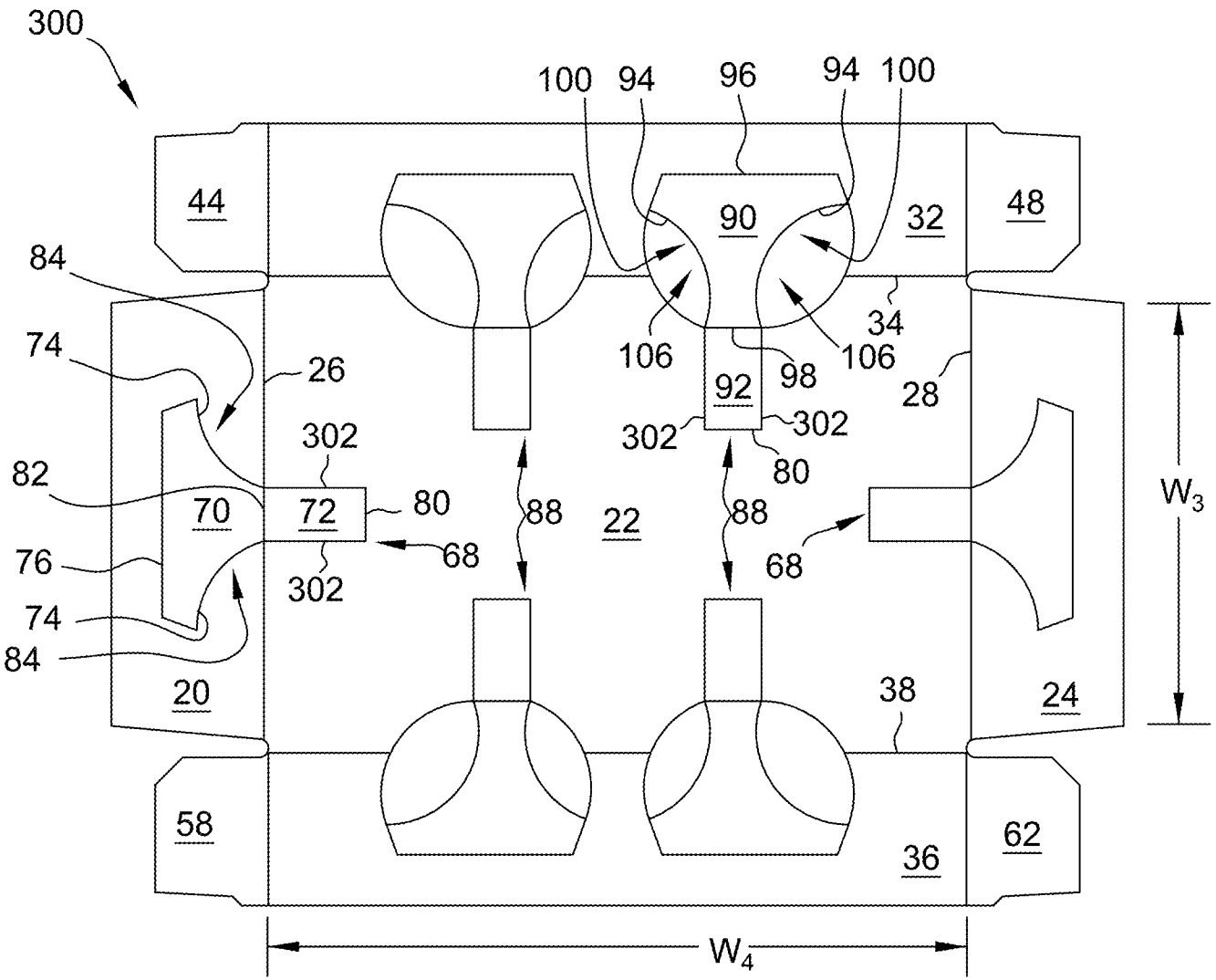

FIG. 3 is a top view of a first alternative blank 300 of sheet material for forming a container (not shown). Blank 300 is substantially similar to blank 10 (shown in FIG. 1), except blank 300 is configured to secure two tubs 900 (shown in FIG. 9) across its width W3 and three tubs 900 across width W4. First and second divider panel assemblies 68 and 88 are substantially similar to first and second divider panel assemblies 68 and 88 of blank 10. As such, components shown in FIG. 3 are labeled with the same reference numbers used in FIG. 1. In the exemplary embodiment, first and second divider panel assemblies 68 and 88 have side cut lines 302. Side cut lines 302 are substantially similar to side cut lines 78 of blank 10 except that side cut lines 302 are longer in length compared to side cut lines 78.

Figure 4:
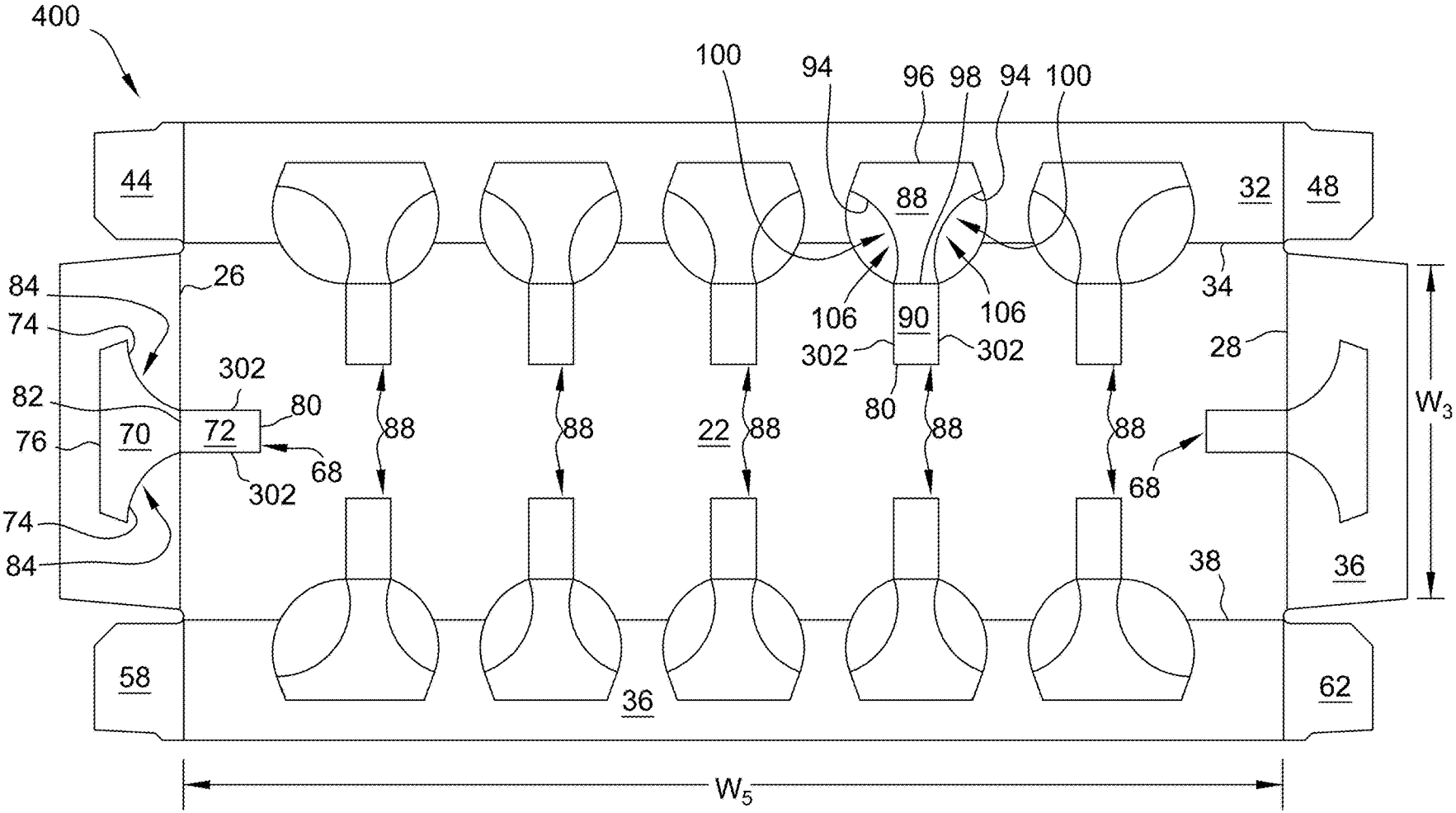

FIG. 4 is a top view of a first alternative blank 400 of sheet material for forming a container (not shown). Blank 400 is substantially similar to blank 10 (shown in FIG. 1) and blank 300 (shown in FIG. 3), except blank 400 is configured to secure two tubs 900 (shown in FIG. 9) across its width W3 and six tubs 900 across width $W_5$. First and second divider panel assemblies 68 and 88 are substantially similar to first and second divider panel assemblies 68 and 88 of blanks 10 and 300. As such, components shown in FIG. 4 are labeled with the same reference numbers used in FIGS. 1 and 3.

Figure 5:
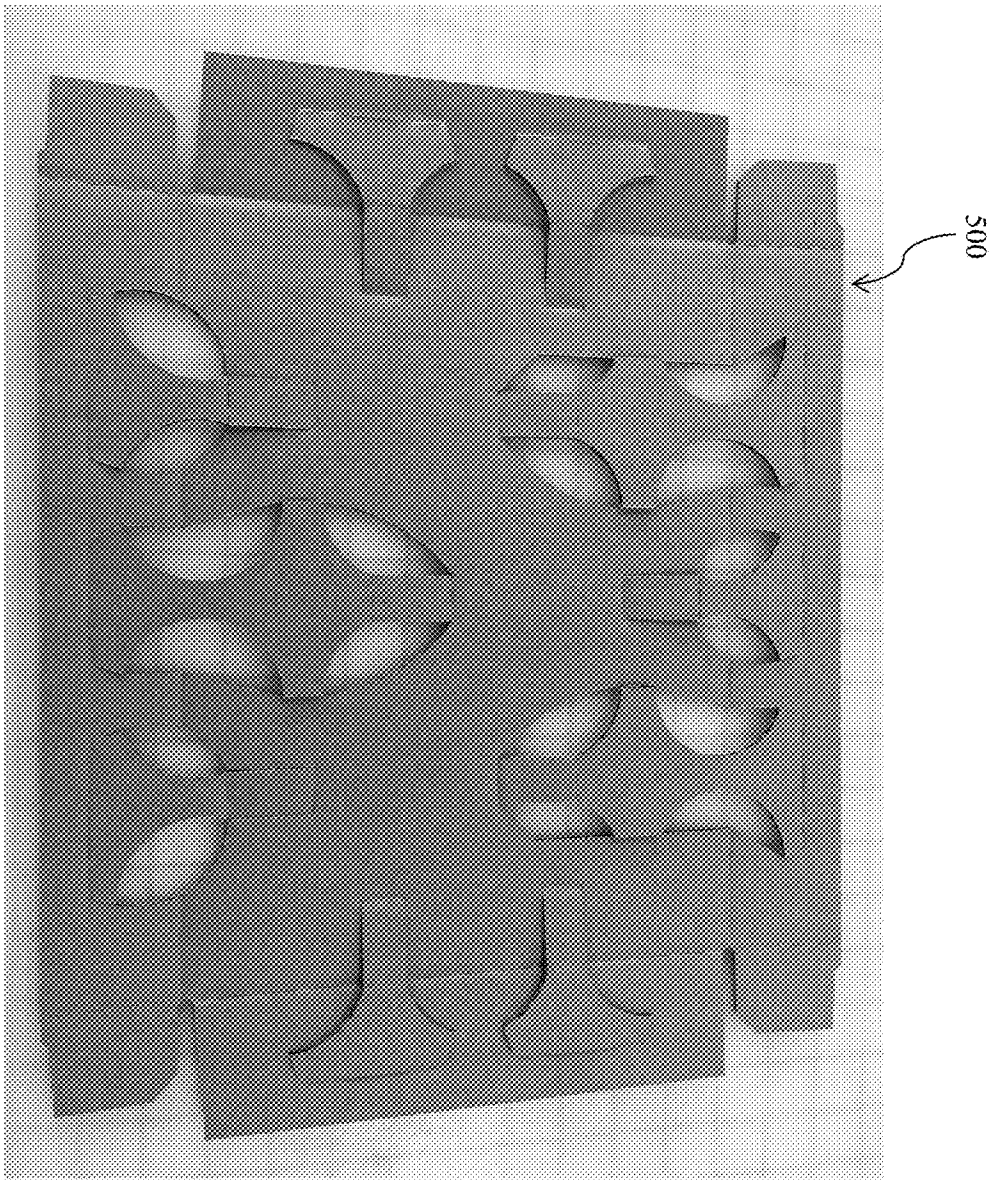

FIG. 5 is a top view photograph of a prototype 500 of blank 10, shown in FIG. 1, made of sheet material for forming container 140, shown in FIG. 2 configured to secure tubs 900 (shown in FIG. 9).

Figure 6:
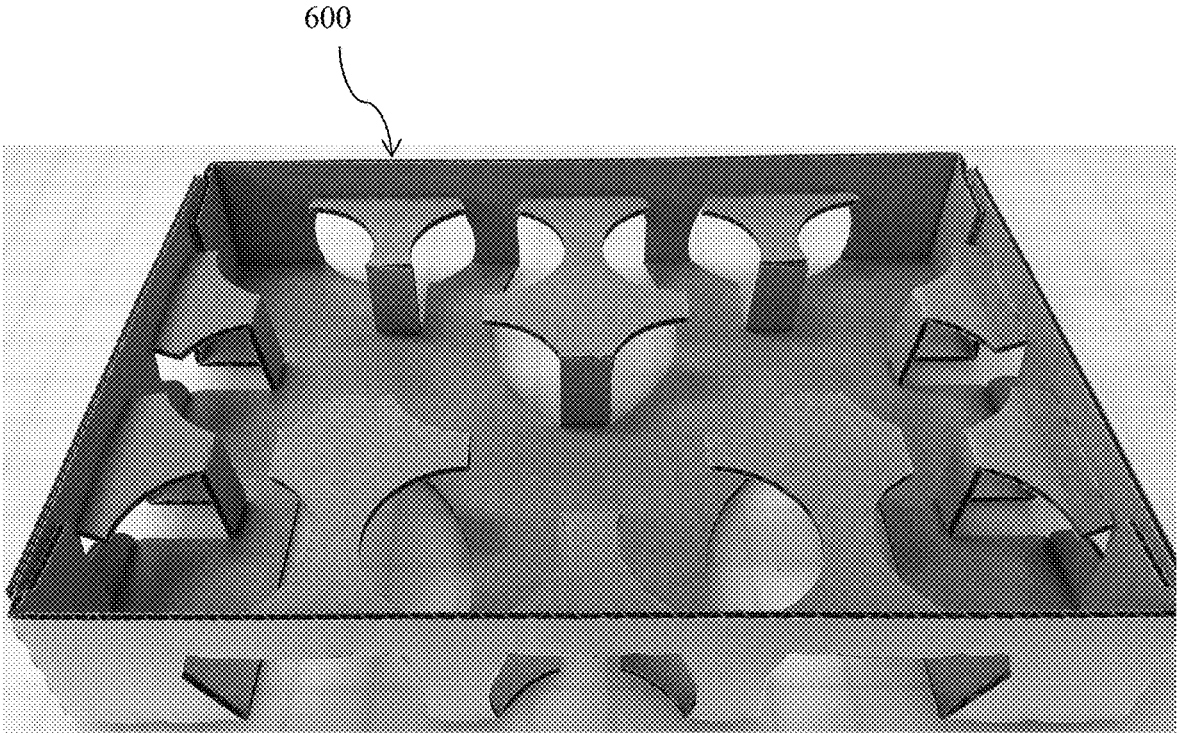

FIG. 6 is a perspective top view photograph of a constructed prototype 600 of prototype blank 500 (shown in FIG. 5) made of sheet material for forming container 140, shown in FIG. 2 configured to secure tubs 900 (shown in FIG. 9).

Figure 7:
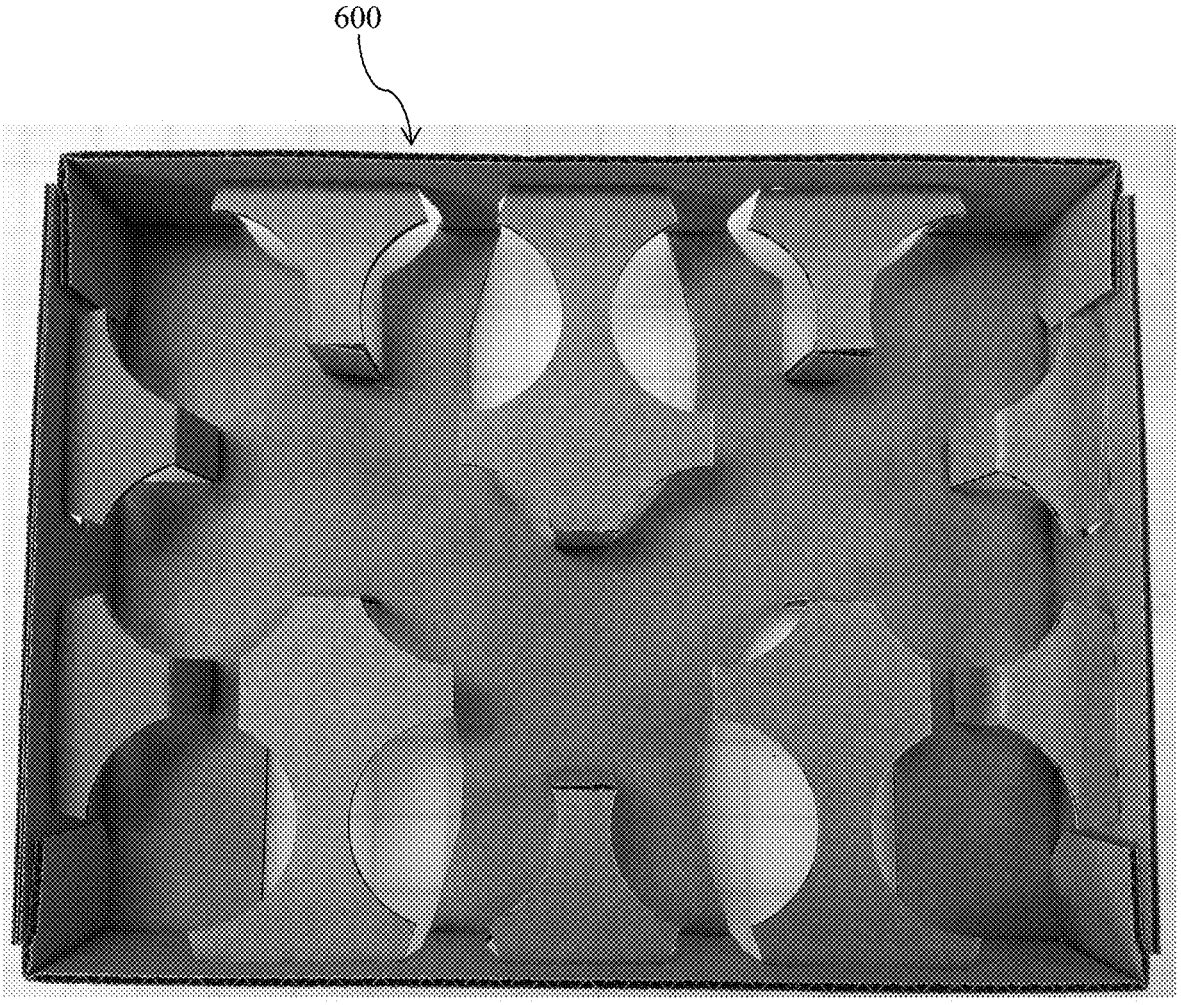

FIG. 7 is a top view photograph of a constructed prototype 600 (shown in FIG. 6) of prototype blank 500 (shown in FIG. 5) made of sheet material for forming container 140, shown in FIG. 2 configured to secure tubs 900 (shown in FIG. 9).

Figure 8:
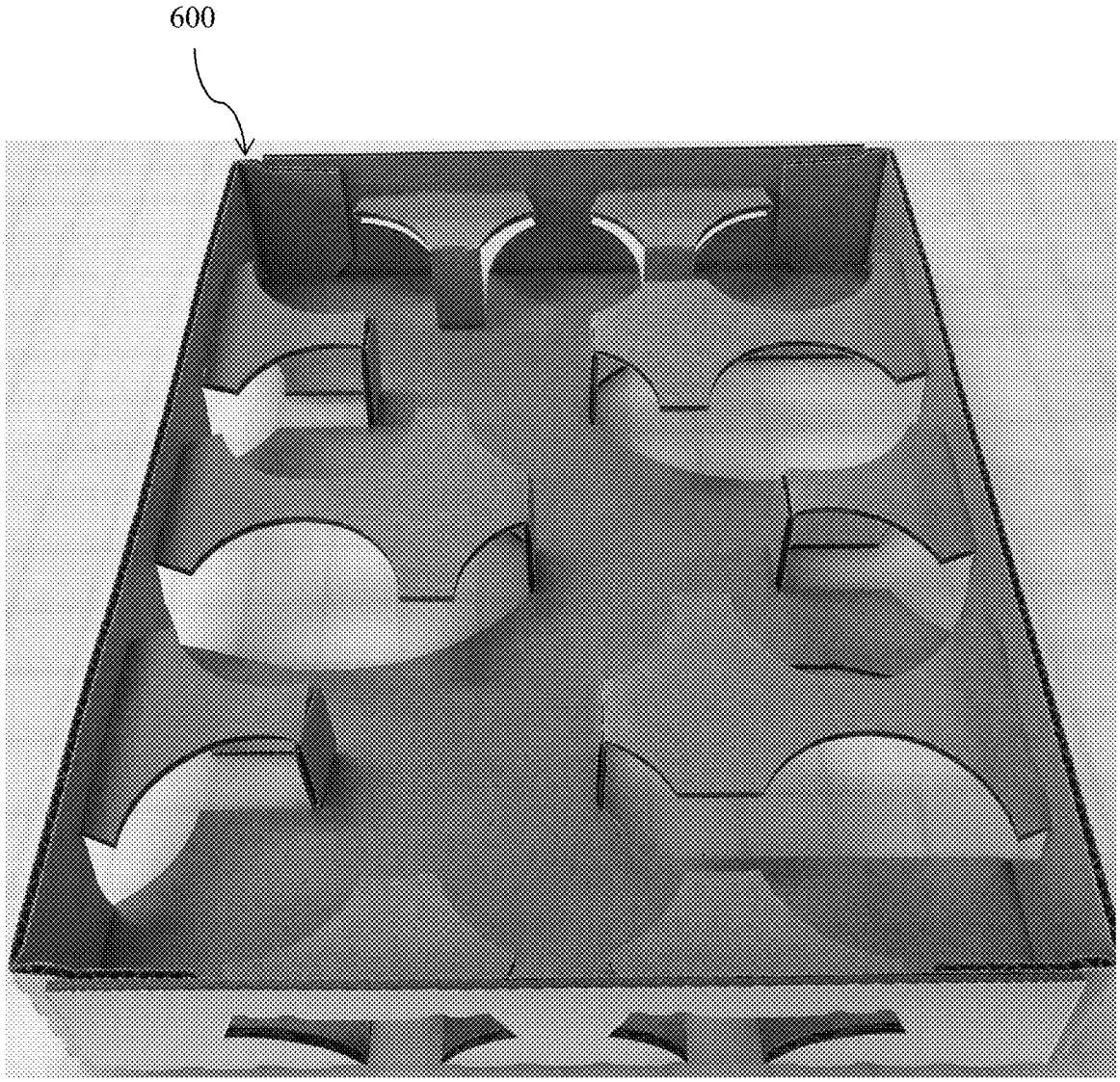

FIG. 8 is a perspective side view photograph of a constructed prototype 600 (shown in FIG. 6) of prototype blank 500 (shown in FIG. 5) made of sheet material for forming container 140, shown in FIG. 2 configured to secure tubs 900 (shown in FIG. 9).

FIG. 9 is a top view photograph of constructed prototype 600 (shown in FIG. 6) having tubs 900 therein. Top 902 of tubs 900 fit securely in prototype 600. In the exemplary embodiment, a substantial portion of a circumference of the tubs 900 that is secured by the first, second, and third divider panel assemblies is about 30% of the circumference of the tub. In other embodiments, the substantial portion of the circumference of the tubs that is secured by the first, second, and third divider panel assemblies can range from about 25% of the circumference of the tubs 900 to about 95% of the circumference of the tubs 900.

Figure 10:
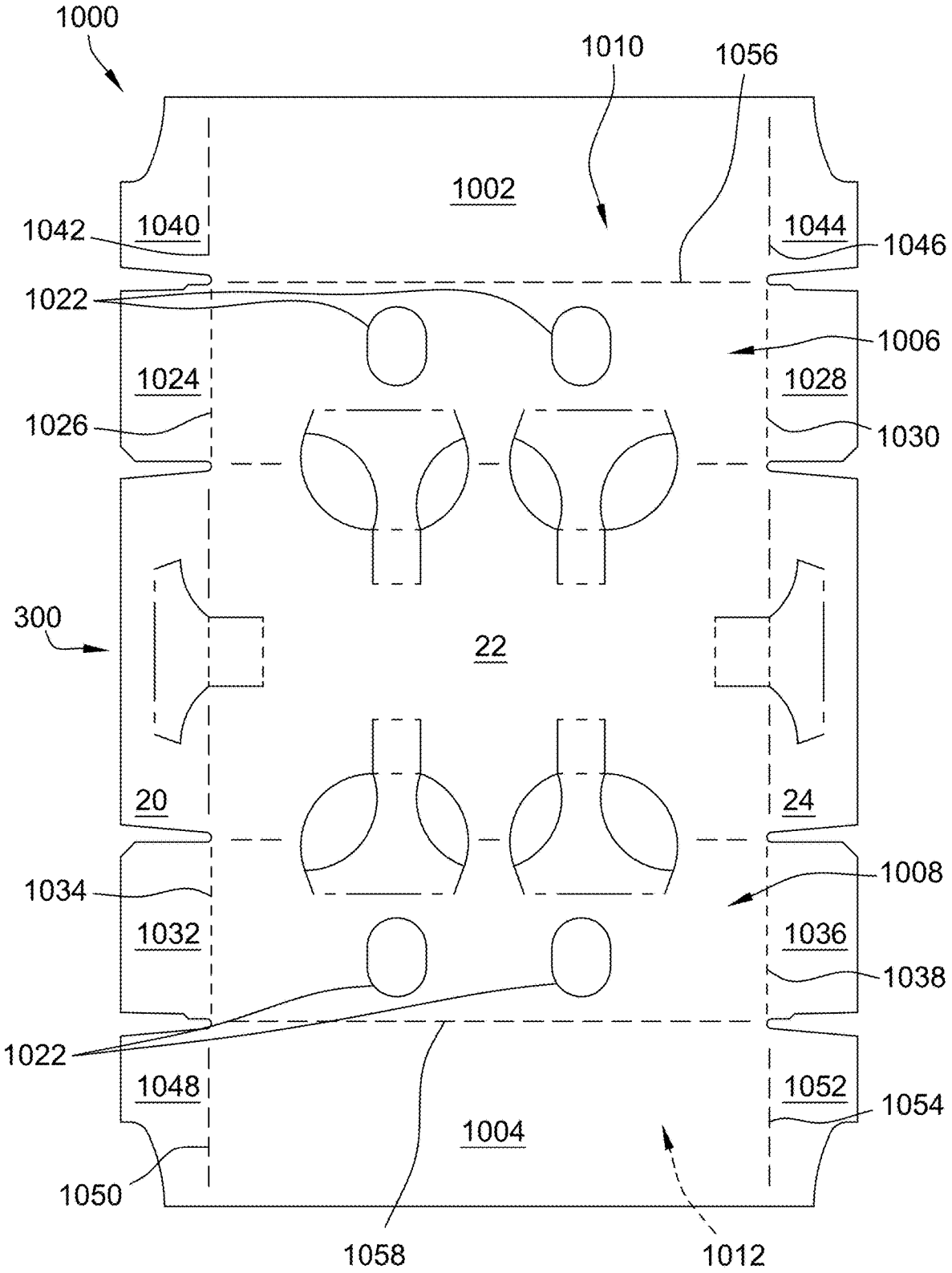
Figure 11:
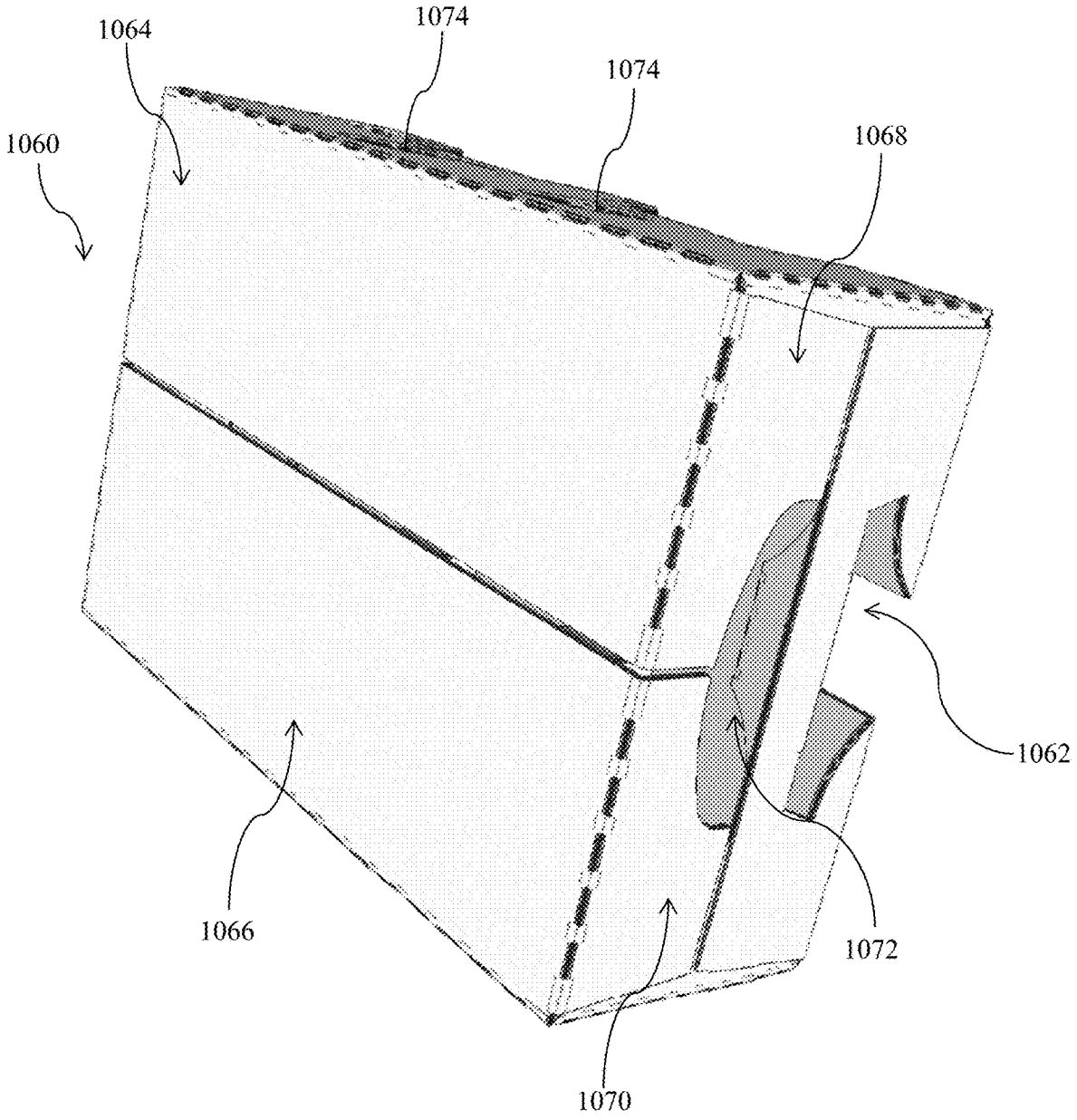

FIG. 10 is a top view of a second alternative embodiment of a blank that may be used to form a container with a lid as described herein. FIG. 11 is a perspective view of the container formed from the blank shown in FIG. 10 Specifically, FIG. 10 is a top view of a second alternative blank 1000 of sheet material for forming a container 1060, shown in FIG. 11.

Referring to FIGS. 10 and 11, blank 1000 includes blank 300, extra lid panels 1002 and 1004, and different side panels 1006 and 1008 than side panels 32 and 36 of blank 300. Like blank 300, blank 1000 includes an interior surface 1010 and an exterior surface 1012. In the exemplary embodiment, side panels 1006 and 1008 are different from side panels 32 and 36 of blank 300 in that side panels 1006 and 1008 each include cutouts 1022. In other embodiments, side panels 1006 and 1008 may contain more cutouts 1022, no cutouts at all, and/or a different number of cutouts on each side panel 1006 and 1008. Blank 1000 includes first end flap 1024 with fold line 1026, second end flap 1028 with fold line 1030, third end flap 1032 with fold line 1034, and fourth end flap 1036 with fold line 1038. Blank 1000 is formed into container 1060 in substantially the same way that blank 10 is formed into container 140, excluding how the lid of the container 1060 is formed, which is described below.

Blank 1000 includes a first lid panel 1002 extends from a first side edge of side panel 1006 at a fold line 1056 and a second lid panel 1004 that extends from a second side edge of side panel 1008 at a fold line 1058. First lid flap 1040 extends from an end edge of first lid panel 1002 at a fold line 1042, a second lid flap 1044 that extends from an opposing end edge of first lid panel 1002 at a fold line 1046, a third lid flap 1048 that extends from opposing lid panel 1004 at a fold line 1050, and a fourth lid flap 1052 that extends from an opposing end edge of second lid panel 1004 at a fold line 1054.

Container 1060 is formed in a substantially similar way to container 140 (shown in FIG. 2), but container 1060 includes the formation of a lid as well. Bottom portion 1062 of container 1060 is the portion of container 1060 that is formed in substantially the same way as container 140. A first lid portion 1064 of container 1060 is formed when first lid panel 1002 is folded along fold line 1056 to a position that is substantially parallel to bottom panel 22. A second lid portion 1066 of container 1060 is formed when second lid panel 1004 is folded along fold line 1058 to a position that is substantially parallel to bottom panel 22. A first lid flap 1068 is created when lid flaps 1040 and 1044 are folded along respective fold lines 1042 and 1046. First lid flap 1068 is substantially perpendicular to first lid panel 1002. A second lid flap 1070 is created when lid flaps 1048 and 1052 are folded along respective fold lines 1050 and 1054. Second lid flap 1070 is substantially perpendicular to second lid panel 1004. Lid flaps 1068 and 1070 are attached to bottom portion 1062 with any suitable adhesive. Lid flaps 1068 and 1070 create opening 1072 in container 1060. Cutouts 1074 in container 1060 are formed from cutouts 1022 in blank 1000.

The above-described embodiments provide a container for supporting a plurality of tubs and/or products by securing a each of the plurality of tubs and/or products. More specifically, the divider panel assemblies defined within the side, end, and bottom panels fully secure each of the plurality of tubs and/or products by securing a portion of each circumference of the tubs and/or products. Further, because each tub is in contact with two divider structures configured to correspond to the shape of the container, each tub is fully secured, and adjacent tubs will not nest into each other when the container is moved.

Exemplary embodiments of a container for supporting tubs and a blank for making the same are described above in detail. The methods, blanks, and containers are not limited to the specific embodiments described herein, but rather, components of blanks and/or containers and/or steps of the methods may be utilized independently and separately from other components and/or steps described herein. Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A blank for forming a container, the blank comprising:

a bottom panel;

a pair of opposing end panels each connected to the bottom panel at a respective first fold line;

a pair of opposing side panels each connected to the bottom panel at a respective second fold line;

a first divider panel assembly defined within the bottom panel and a first end panel of the pair of end panels, the first divider panel assembly comprising a first upper panel and a first inner panel connected at a third fold line aligned with the first fold line, the first upper panel defined within the first end panel and the first inner panel defined within the bottom panel, wherein the first upper panel is configured to be at a first angle to the first end panel and the first inner panel is configured to be at a second angle to the bottom panel in an erected configuration, the first upper panel having a first arcuate edge forming a first engagement edge when the blank is formed into the container;

a second divider panel assembly defined within the bottom panel and a first side panel of the pair of side panels, the second divider panel assembly comprising a second upper panel and a second inner panel connected at a fourth fold line, wherein the fourth fold line is offset from the second fold line, wherein the second upper panel is configured to be at a third angle to the first side panel and the second inner panel is configured to be at a fourth angle to the bottom panel in the erected configuration, and the second upper panel having a second arcuate edge extending from the first side panel to the fourth fold line, the second arcuate edge forming a second engagement edge when the blank is formed into the container; and a third divider panel assembly defined within the bottom panel and the first side panel of the pair of side panels, the third divider panel assembly comprising a third upper panel and a third inner panel connected at a fifth fold line, wherein the fifth fold line is offset from the second and fourth fold lines, wherein the third upper panel is configured to be at a fifth angle to the first side panel and the third inner panel is configured to be at a sixth angle to the bottom panel in the erected configuration, and the third upper panel having a third arcuate edge forming a third engagement edge when the blank is formed into the container and a fourth arcuate edge offset from the third arcuate edge in a direction away from the first side panel;

wherein each end panel comprises at least two first divider panel assemblies;

wherein the first side panel comprises two second divider panel assemblies and one third divider panel assembly, the third divider panel assembly being disposed between the two second divider panel assemblies;

wherein the second side panel comprises two third divider panel assemblies and one second divider panel assemblies, the second divider panel assembly of the second side panel being disposed between the two third divider panel assemblies of the second side panel.

2. A blank in accordance with claim 1, wherein the fifth fold line is offset from the fourth fold line in the direction away from the first side panel.

* * * * *